US011335272B2

(12) United States Patent
Lee et al.

(10) Patent No.: US 11,335,272 B2
(45) Date of Patent: May 17, 2022

(54) OLED DRIVING CHARACTERISTIC DETECTION CIRCUIT AND OLED DISPLAY DEVICE INCLUDING THE SAME

(71) Applicant: Samsung Electronics Co., Ltd., Suwon-si (KR)

(72) Inventors: Ha Jun Lee, Seoul (KR); Jeong Ah Ahn, Hwaseong-si (KR); Ji-Yong Jeong, Seoul (KR); Suk-Yun Woo, Hwaseong-si (KR); Young Sub Jin, Seoul (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 93 days.

(21) Appl. No.: 16/793,466

(22) Filed: Feb. 18, 2020

(65) Prior Publication Data

US 2021/0043148 A1 Feb. 11, 2021

(30) Foreign Application Priority Data

Aug. 5, 2019 (KR) ..... 10-2019-0094737

(51) Int. Cl.
*G09G 3/3291* (2016.01)

(52) U.S. Cl.
CPC ... *G09G 3/3291* (2013.01); *G09G 2300/0408* (2013.01); *G09G 2300/0852* (2013.01); *G09G 2310/0294* (2013.01)

(58) Field of Classification Search
CPC ..... G09G 3/3291; G09G 2300/0408; G09G 2300/0852; G09G 2310/0294
See application file for complete search history.

(56) References Cited

U.S. PATENT DOCUMENTS

| | | | | |
|---|---|---|---|---|
| 6,278,283 | B1 | 8/2001 | Tsugai | |
| 9,349,311 | B2 | 5/2016 | Yu et al. | |
| 9,870,097 | B2 | 1/2018 | Joharapurkar et al. | |
| 9,905,160 | B2 * | 2/2018 | Woo | G09G 3/3233 |
| 10,074,304 | B2 † | 9/2018 | Chaji | |
| 10,152,179 | B2 | 12/2018 | Park | |

(Continued)

*Primary Examiner* — Amare Mengistu
*Assistant Examiner* — Jennifer L Zubajlo
(74) *Attorney, Agent, or Firm* — Harness, Dickey & Pierce, P.L.C.

(57) ABSTRACT

An organic light-emitting diode (OLED) driving characteristic detection circuit is provided. The OLED driving characteristic detection circuit comprising a first current integrator receiving a first current via a first sensing channel and outputting a first sampling voltage based on the first current, a second current integrator receiving a second current via a second sensing channel and outputting a second sampling voltage based on the second current, and a sampling circuit receiving the first and second sampling voltages, followed by storing and holding the first and second sampling voltages, and removing common noise components included in the first and second sampling voltages, a third sampling capacitor and a fourth sampling capacitor which are connected to an output terminal of the second current integrator and store and hold the second sampling voltage, and a plurality of switches which connect first ends of the first sampling capacitor to the fourth sampling capacitor.

20 Claims, 15 Drawing Sheets

(56) References Cited

U.S. PATENT DOCUMENTS

| | | | | |
|---|---|---|---|---|
| 2015/0379909 | A1* | 12/2015 | Yu | G09G 3/3258 345/690 |
| 2018/0114815 | A1* | 4/2018 | Lee | H01L 51/50 |
| 2018/0174522 | A1 | 6/2018 | Lee et al. | |

* cited by examiner
† cited by third party

OLED DRIVING CHARACTERISTIC DETECTION CIRCUIT AND OLED DISPLAY DEVICE INCLUDING THE SAME

This application claims priority from Korean Patent Application No. 10-2019-0094737, filed on Aug. 5, 2019 in the Korean Intellectual Property Office, the disclosure of which is incorporated herein in its entirety.

BACKGROUND

1. Technical Field

The present disclosure relates to an organic light-emitting diode (OLED) driving characteristic detection circuit and an OLED display device including the OLED driving characteristic detection circuit, and more particularly, to an OLED driving characteristic detection circuit that is capable of sensing the electrical characteristics of a driving element, and an OLED display device including the OLED driving characteristic detection circuit.

2. Description of the Related Art

An active matrix-type organic light-emitting diode display device includes OLEDs, which can emit light by themselves, and have numerous advantages such as fast response speed, excellent emission efficiency, excellent luminance, and wide viewing angles.

In the organic light-emitting diode display device, a plurality of pixels, each including an OLED and a driving thin-film transistor (TFT), are arranged in a matrix, and the luminance of an image realized by the pixels is controlled in accordance with the gray level of video data. The driving TFT controls a driving current flowing in the OLED in accordance with the voltage applied between the gate electrode and the source electrode of the driving TFT. The amount of light emitted from the OLED is determined by the driving current, and the luminance of an image is determined by the amount of light emitted from the OLED.

When the driving TFT operates in a saturation region, a pixel current that flows between the drain and the source of the driving TFT changes depending on the electrical characteristics of the driving TFT such as a threshold voltage and electron mobility. If deviations in electrical characteristics arise between the pixels for various reasons such as process characteristics and time-varying characteristics, luminance deviations may arise between the pixels, even if the same data voltages are applied to the pixels. Unless such deviations are addressed, it may be difficult to realize a desired-quality image.

In a conventional voltage sensing-based compensation method, in which not the current flowing in a driving TFT, but the voltage corresponding to the current, is used to detect the electrical characteristics of the driving TFT, the current is converted into, and stored as, a source voltage, using a parasitic capacitor in a sensing line, and then, the source voltage is sensed. In this case, precise sensing data may not be able to be obtained because the size of the parasitic capacitor is relatively large and the data may vary depending on the load of a display panel.

In order to address the shortcomings of the conventional voltage sensing-based compensation method, a current sensing-based compensation method using a current integrator may be used, but it is still difficult to obtain precise sensing data due to the offset of the current integrator and external noise that may affect voltages.

SUMMARY

Embodiments of the present disclosure provide an organic light-emitting diode (OLED) driving characteristic detection circuit with improved operating characteristics.

Embodiments of the present disclosure also provide an OLED display device with improved operating characteristics.

However, embodiments of the present disclosure are not restricted to those set forth herein. The above and other embodiments of the present disclosure will become more apparent to one of ordinary skill in the art to which the present disclosure pertains by referencing the detailed description of the present disclosure given below.

According to an aspect of the present inventive concepts, an organic light-emitting diode driving characteristic detection circuit comprises a first current integrator configured to receive a first current via a first sensing channel and output a first sampling voltage based on the first current, a second current integrator configured to receive a second current via a second sensing channel and output a second sampling voltage based on the second current, and a sampling circuit having a first sampling capacitor, a second sampling capacitor, a third sampling capacitor, and a fourth sample capacitor, the first sampling capacitor and the second sampling capacitor connected to an output terminal of the first current integrator and configured to store and hold the first sampling voltage, the third sampling capacitor and the fourth sampling capacitor connected to an output terminal of the second current integrator and configured to store and hold the second sampling voltage, and a plurality of switches which connect first ends of the first sampling capacitor, the second sample capacitor, the third sample capacitor, and the fourth sampling capacitor, and the sampling circuit configured to receive the first and second sampling voltages, to store and hold the first and second sampling voltages, and to remove common noise components included in the first and second sampling voltages.

According to another aspect of the present inventive concepts, an organic light-emitting diode driving characteristic detection circuit comprises a first current integrator configured to receive a first current via a first sensing channel and output a first sampling voltage based on the first current, a second current integrator configured to receive a second current via a second sensing channel and output a second sampling voltage based on the second current, and a sampling circuit configured to receive the first and second sampling voltages, followed by storing and holding the first and second sampling voltages, and remove common noise components included in the first and second sampling voltages, the sampling circuit including a first sampling capacitor configured to store the first sampling voltage, a first sampling switch connected between an output terminal of the first current integrator and the first sampling capacitor, the first sampling switch configured to be turned off in a first period to complete the storing of the first sampling voltage in the first sampling capacitor, a second sampling capacitor configured to store the first sampling voltage, a second sampling switch connected between the output terminal of the first current integrator and the second sampling capacitor, the second sampling switch configured to be turned off in a second period after the first period to complete the storing of the first sampling voltage in the second sampling capacitor, a third sampling capacitor configured to store the second sampling voltage, a third sampling switch connected between the output terminal of the second current integrator and the third sampling capacitor, the third sampling switch configured to be turned off in the first period to complete the storing of the second sampling voltage in the third sampling capacitor, a fourth sampling capacitor configured to store the second sampling voltage, and a fourth sampling switch connected between the output terminal of the second current integrator and the fourth sampling capacitor, the fourth sampling switch configured to be turned off in the second period to complete the storing of the second sampling voltage in the fourth sampling capacitor.

According to another aspect of the present inventive concepts, an organic light-emitting diode display device comprises a display panel having a plurality of pixels connected to data lines and sensing lines, the plurality of pixels including an organic light-emitting diode (OLED) and a driving thin-film transistor (TFT), the driving TFT configured to control an amount of light emitted by the OLED; and a data driving circuit including a digital-to-analog converter (DAC), a plurality of sensing circuits, and an analog-to-digital converter (ADC), the DAC configured to apply data voltages for sensing to the data lines during a sensing operation, the plurality of sensing circuits configured to senses current information of the pixels via a plurality of sensing channels, connected to the sensing lines, during the sensing operation, each of the sensing circuits including a first current integrator, a second current integrator, a sampling circuit, the first current integrator configured to receive a first current via a first sensing channel and output a first sampling voltage, the second current integrator configured to receive a second current via a second sensing channel and output a second sampling voltage, and the sampling circuit configured to receive, store, and hold the first sampling voltage and the second sampling voltage and remove common noise components included in the first sampling voltage and the second sampling voltage, the sampling circuit including a first sampling capacitor and a second sampling capacitor connected to an output terminal of the first current integrator and configured to store the first sampling voltage, a third sampling capacitor and a fourth sampling capacitor connected to an output terminal of the second current integrator and configured to store the second sampling voltage, and a plurality of switches connecting first ends of the first sampling capacitor, the second sampling capacitor, the third sampling capacitor, and the fourth sampling capacitor, and the ADC is connected in common to the sensing circuits.

Other features and embodiments may be apparent from the following detailed description, the drawings, and the claims.

BRIEF DESCRIPTION OF THE DRAWINGS

The above and other embodiments and features of the present disclosure will become more apparent by describing in detail example embodiments thereof with reference to the attached drawings, in which.

DETAILED DESCRIPTION

Although the terms "first," "second," "third," etc., may be used herein to describe various elements, components, regions, layers, and/or sections, these elements, components, regions, layers, and/or sections, should not be limited by these terms. These terms are only used to distinguish one element, component, region, layer, or section, from another region, layer, or section. Thus, a first element, component, region, layer, or section, discussed below may be termed a second element, component, region, layer, or section, without departing from the scope of this disclosure.

The structure of an organic light-emitting diode ("OLED") display device and problems that arise in a conventional current sensing-based compensation method will hereinafter be described with reference to FIGS. 1 to 3B.

Figure 1:
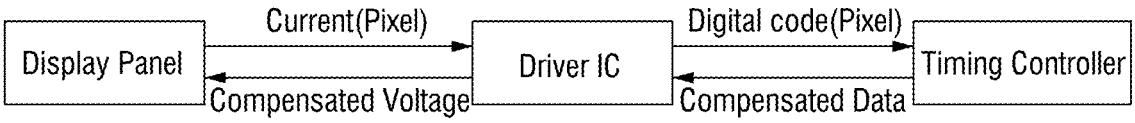
FIG. 1 is a block diagram of an organic light-emitting diode display device that performs compensation in a current sensing manner.
Figure 2A:
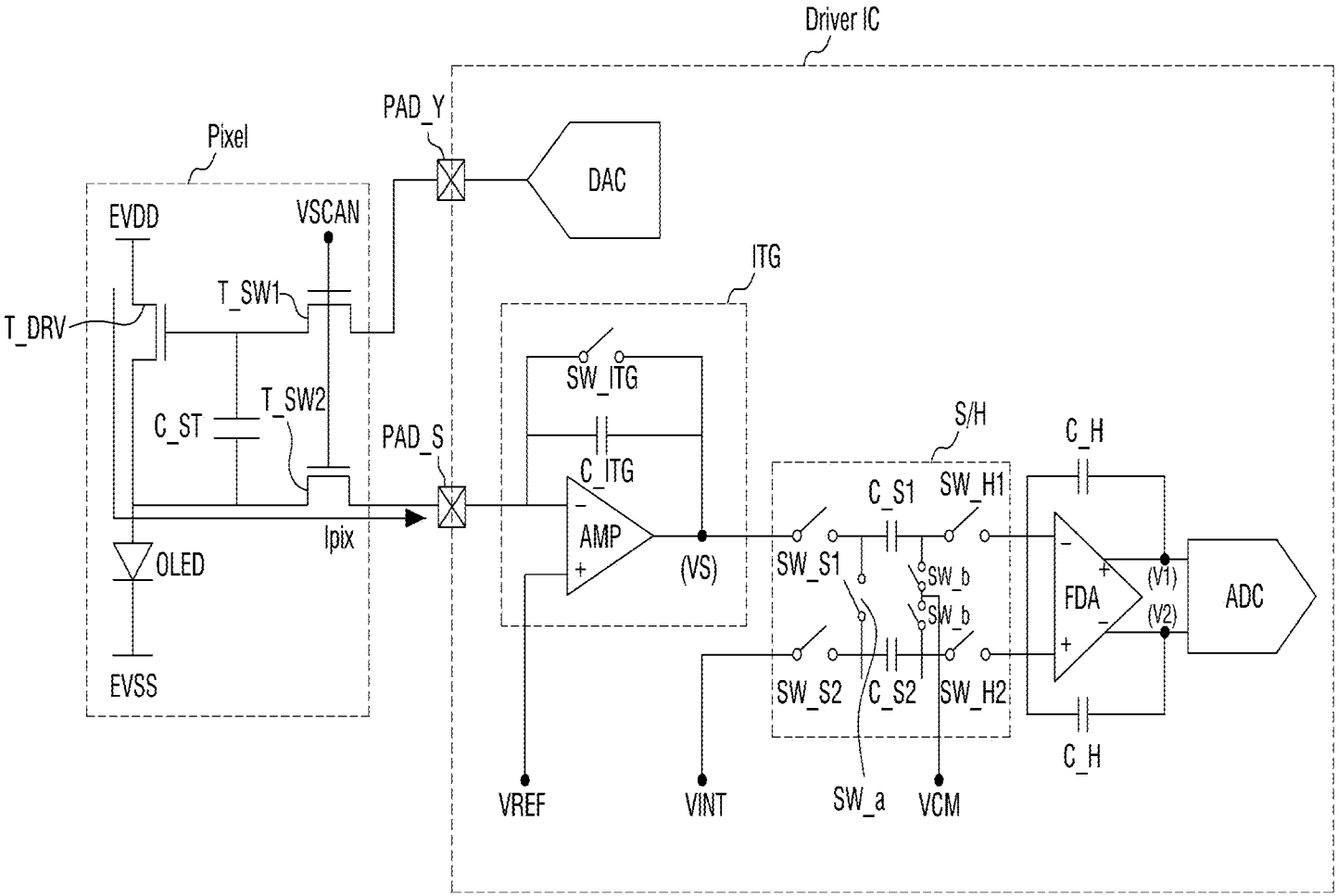
FIG. 2A is a circuit diagram illustrating how a pixel to which a current sensing-based compensation method is applied is connected to a driver integrated circuit (IC)
Figure 2B:
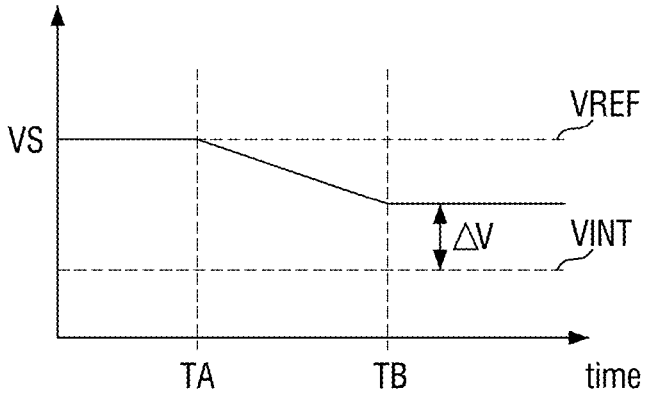
FIG. 2B is a graph showing the output of a current integrator of FIG. 2A.

FIG. 1 is a block diagram of an organic light-emitting diode display device that performs compensation in a current sensing manner. FIG. 2A is a circuit diagram illustrating how a pixel to which a current sensing-based compensation method is applied is connected to a driver integrated circuit (IC), and FIG. 2B is a graph showing the output of a current integrator of FIG. 2A.

Referring to FIG. 1, the OLED display device may include a display panel, a driver IC, and a timing controller. The driver IC may include a sensing block and senses current information input from the display panel. The sensing block includes a plurality of current integrators and integrates the current information input from the display panel. Pixels of the display panel are connected to sensing lines, and the current integrators are connected to the sensing lines via sensing channels. Integration values (e.g., integration reference voltage values) obtained by the current integrators are input to an analog-to-digital converter (ADC) through sampling and holding. The ADC transmits digital code, which is converted from analog integration values into digital sensing values, to a timing controller. The timing controller deduces compensated data, which is for compensating for threshold voltage and mobility deviations, from the digital sensing values, modulates image data, which is for realizing an image, using the compensated data, and transmits the modulated image data to the driver IC. The modulated image data is converted into data voltages for displaying an image by the driver IC, and the data voltages are applied to the display panel.

Referring to FIG. 2A, a pixel "Pixel" may include an OLED "OLED", a driving transistor T_DRV, a storage capacitor C_ST, a first switch transistor T_SW1, and a second switch transistor T_SW2.

The OLED "OLED" may include an anode electrode connected to the driving transistor T_DRV, a cathode electrode connected to the input terminal of a low-potential driving voltage EVSS, and an organic compound layer between the anode electrode and the cathode electrode. The driving transistor T_DRV may be implemented as a thin-film transistor (TFT). The driving transistor T_DRV may control the amount of current input to the OLED "OLED" in accordance with the gate-source voltage of the driving transistor T_DRV. The driving transistor T_DRV may include a gate electrode, a drain electrode connected to the input terminal of a high-potential driving voltage EVDD, and a source electrode connected to the anode electrode of the OLED "OLED". The storage capacitor C_ST may connect the gate electrode and the source electrode of the driving transistor T_DRV. The first switch transistor T_SW1, may receive a data voltage from a digital-to-analog converter (DAC) "DAC" via a data pad PAD_Y, and may apply the data voltage to the gate electrode of the driving transistor T_DRV in response to a gate pulse SCAN. The second switch transistor T_SW2 may switch the flow of a current in a sensing line in response to a gate pulse SCAN. While a pixel current Ipix is flowing in the sensing line in response to the first and second transistors T_SW1 and T_SW2 being turned on, a low-potential driving voltage EVSS lower than a threshold level may be applied so that the OLED "OLED" may not affect the flow of the pixel current Ipix.

A current integrator ITG may include an amplifier AMP. The amplifier AMP may include an inverted input terminal (−), a non-inverted input terminal (+), and an output terminal. The inverted input terminal (−) may be connected to the sensing line of the pixel "Pixel" via a sensing pad PAD_S and receive the pixel current Ipix (e.g., the source-drain current of the driving transistor T_DRV). The non-inverted input terminal (+) may receive a reference voltage VREF. The current integrator ITG may further include an integration capacitor C_ITG connected between the inverted input terminal (−) and the output terminal of the amplifier AMP, and a reset switch SW_ITG connected to both ends of an integration capacitor C_ITG.

The current integrator ITG is connected to an analog-to-digital converter (ADC) "ADC" via a sampling circuit (e.g., a sample/hold circuit S/H) and a fully differential amplifier (FDA) "FDA".

The sample/hold circuit S/H may include two sampling switches SW_S1 and SW_S2, sampling capacitors C_S1 and C_S2, and hold switches SW_H1 and SW_H2. The sampling switch SW_S1 may sample an output voltage VS of the amplifier AMP and an initial voltage VINT. The sampling capacitor C_S1 may store the output voltage VS of the amplifier AMP, applied thereto via the sampling switch SW_S1. The sampling capacitor C_S2 may store the initial voltage VS applied thereto via the sampling switch SW_S2. The hold switches SW_H1 and SW_H2 may transmit the output voltage VS and the initial voltage VINT, stored in the sampling capacitors C_S1 and C_S2, respectively, to the FDA "FDA". Also, the sample/hold circuit S/H may include switches SW b for applying a sampling reference voltage VCM to the sampling capacitors C_S1 and C_S2 and a switch SW_a which may connect the sampling capacitors C_S1 and C_S2 by being turned on when the hold switches SW_H1 and/or SW_H2 are turned on.

Referring to FIG. 2B, a driving characteristic sensing operation of the driving transistor T_DRV using the current integrator ITG includes a reset period (~TA), a sensing period (TA~TB), and a transfer period (TB~).

In the reset period (~TA), as the reset switch SW_ITG is turned on, the amplifier AMP may operate as a unit gain buffer having a gain of 1.

In the reset period (~TA), the input terminals (+) and (−) and the output terminal of the amplifier AMP may all initialize to the reference voltage VREF.

In the reset period (~TA), a data voltage for sensing may be applied to the gate of the driving transistor T_DRV via the digital-to-analog converter (DAC) "DAC" of Driver IC "Driver IC", and as a result, the source-drain current of the driving transistor T_DRV, (e.g., the pixel current Ipix) flows and may be stabilized. However, since during the reset period (~TA), the amplifier AMP continues to operate as a unit gain buffer, the output voltage VS of the amplifier AMP may be maintained at the reference voltage VREF.

In the sensing period (TA~TB), as the reset switch SW_ITG is turned off, the amplifier AMP may operate as a current integrator and integrates the pixel current Ipix using the integration capacitor C_ITG. Due to the pixel current Ipix being introduced to the inverted input terminal (−) of the amplifier AMP during the sensing period (TA~TB), the difference in potential between both ends of the integration capacitor C_ITG, (e.g., the amount of current accumulated) increases over time. However, due to the characteristics of the amplifier AMP, the inverted input terminal (−) and the non-inverted input terminal (+) of the amplifier AMP may be short-circuited by a virtual ground so that the difference in potential between the inverted input terminal (−) and the non-inverted input terminal (+) of the amplifier AMP are zero. Thus, the potential of the inverted input terminal (−) of the amplifier AMP during the sensing period (TA~TB) may be maintained at the reference voltage VREF regardless of an increase in the potential of the integration capacitor C_ITG. Instead, the potential of the output terminal of the amplifier AMP may decrease in accordance with the difference in potential between both ends of the capacitor C_ITG. In this manner, the pixel current Ipix, which is introduced via the sensing pad PAD_S during the sensing period (TA~TB), may be converted into the output voltage VS by the integration capacitor C_ITG. As the pixel current Ipix increase, the descending slope of the output voltage VS of the amplifier AMP increases, and the output voltage VS may decrease.

In the sensing period (TA~TB), the sampling capacitor C_S1 may store the output voltage VS via the sampling switch SW_S1, and the sampling capacitor C_S2 may store the initial voltage VINT via the sampling switch SW_S2.

In the transfer period (TB~), as the hold switches SW_H1 and SW_H2 are turned on, the output voltage VS stored in the sampling capacitor C_S1 may be input to the FDA "FDA" via the hold switch SW_H1, and the reference voltage VINT stored in the sampling capacitor C_S2 may be input to the FDA "FDA" via the hold switch SW_H2. Thereafter, the difference between an output voltage V1 of the non-inverted output terminal of the FDA "FDA" and an output voltage V2 of an inverted output terminal of the FDA "FDA" may be input to the ADC "ADC".

The output voltage of the FDA "FDA", which may be based on a difference ΔV between the output voltage VS and the reference voltage VINT, may be converted into a digital sensing value by the ADC "ADC", and the digital sensing value may be transmitted to the timing controller of FIG. 1. The timing controller may deduce a threshold voltage deviation ΔVth and a mobility deviation ΔK of the driving transistor T_DRV by applying the digital sensing value to a previously-stored compensation algorithm, and may deduce compensated data for compensating for the threshold voltage deviation ΔVth and the mobility deviation ΔK.

Figure 3A:
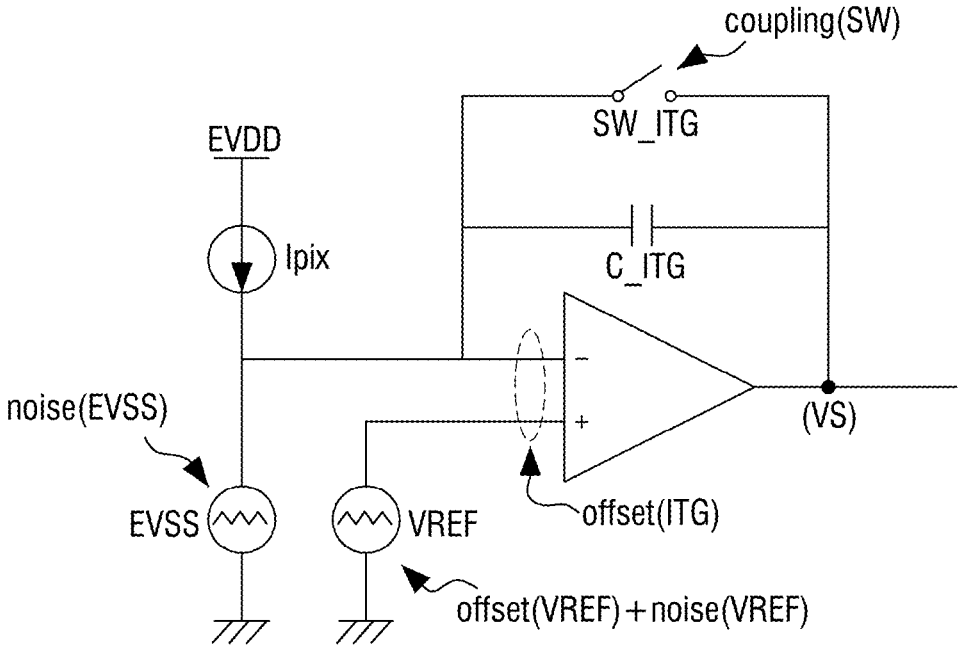
FIG. 3A is a diagram illustrating how noise is generated in the current sensing-based compensation method.
Figure 3B:
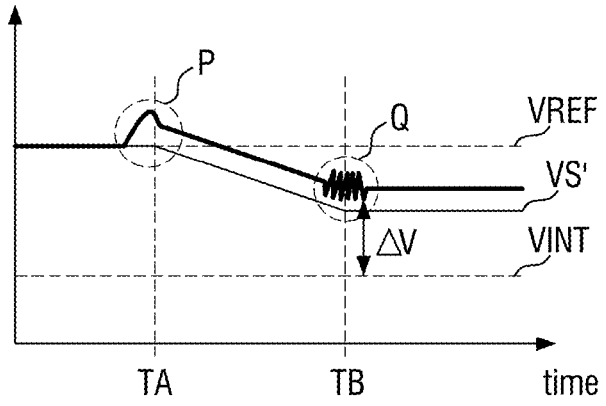
FIG. 3B is a diagram showing the output of a current integrator where error occurs due to the noise of FIG. 3A.

FIG. 3A is a diagram illustrating how noise is generated in the current sensing-based compensation method, and FIG. 3B is a diagram showing the output of a current integrator where error occurs due to the noise of FIG. 3A. Noise that may be generated while a sensing operation is being performed to determine the driving characteristics of the driving transistor T_DRV in accordance with a current sensing method will hereinafter be described with reference to FIGS. 2A to 3B.

A sensing method using the current integrator ITG may be more advantageous than a conventional voltage sensing method in reducing the duration of sensing, but may be susceptible to noise because the target of sensing, (e.g., the pixel current Ipix or the source-drain current of the driving transistor T_DRV) may be very low. Also, noise may be generated in the current integrator ITG and in the reset switch SW_ITG.

As illustrated in FIG. 3A, during the sensing of the pixel current Ipix, the problems of noise "noise(EVSS)", which is generated during the generation of the low-potential driving voltage EVSS, and noise "noise(VREF)", which is generated during the generation of the reference voltage VREF, may arise. Also, during an initialization period, noise "coupling(SW)" may be generated due to the coupling of the reset switch SW_ITG, and noises "offset(ITG)" and "offset (VREF)" may be generated due to the offset of the current integrator ITG, which is connected to a plurality of pixels, and due to the offset of the reference voltage VREF.

As illustrated in FIG. 3B, due to the noises described above, sensing may not be precisely performed. That is, due to the noises "coupling(SW)", "offset(ITG)", and "offset (VREF)", which may be generated during the initialization period, a voltage peak may be generated, as indicated by regionP, due to the noises "noise(EVSS)" and "noise(VREF)", an output voltage VS' may fluctuate, as indicated by region Q, and as a result sensing may not be precisely performed.

An OLED driving characteristic detection circuit according to some embodiments of the present disclosure and an OLED display device, including the OLED driving characteristic detection circuit, according to some embodiments of the present disclosure, will hereinafter be described with reference to FIGS. 4 to 12.

Figure 4:
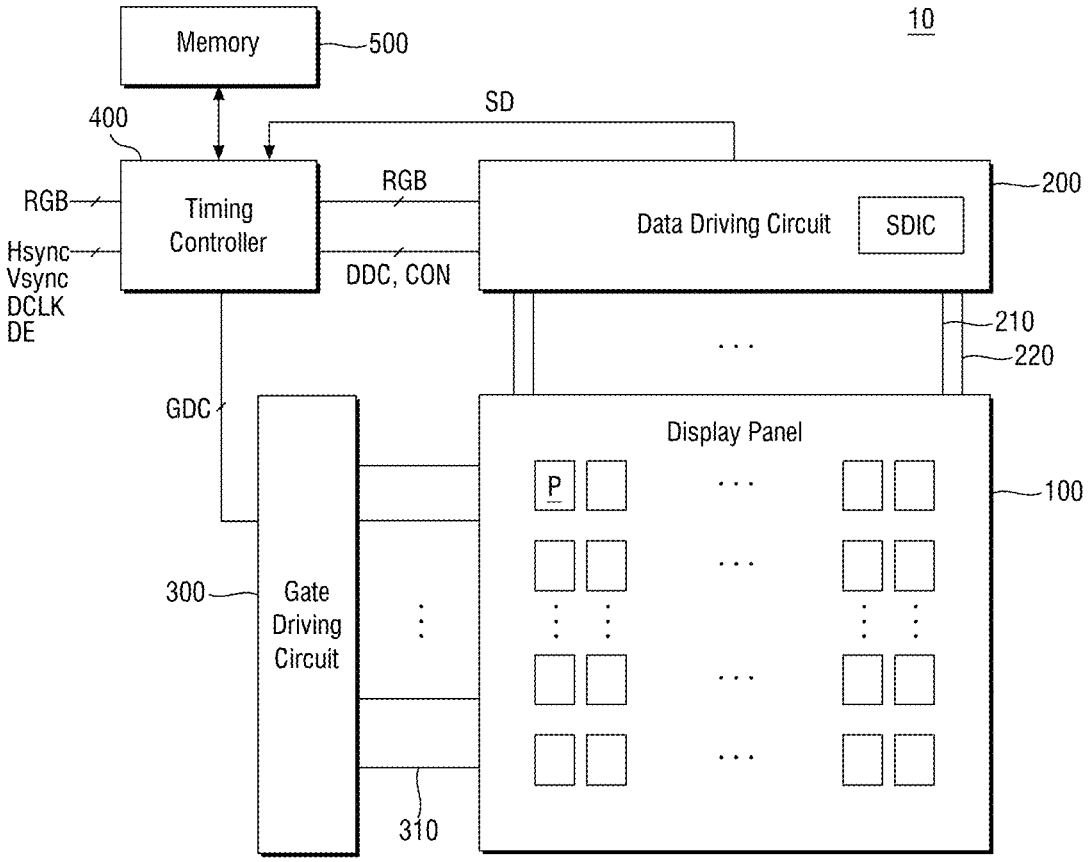
FIG. 4 is a block diagram of an OLED display device according to an example embodiment.
Figure 5:
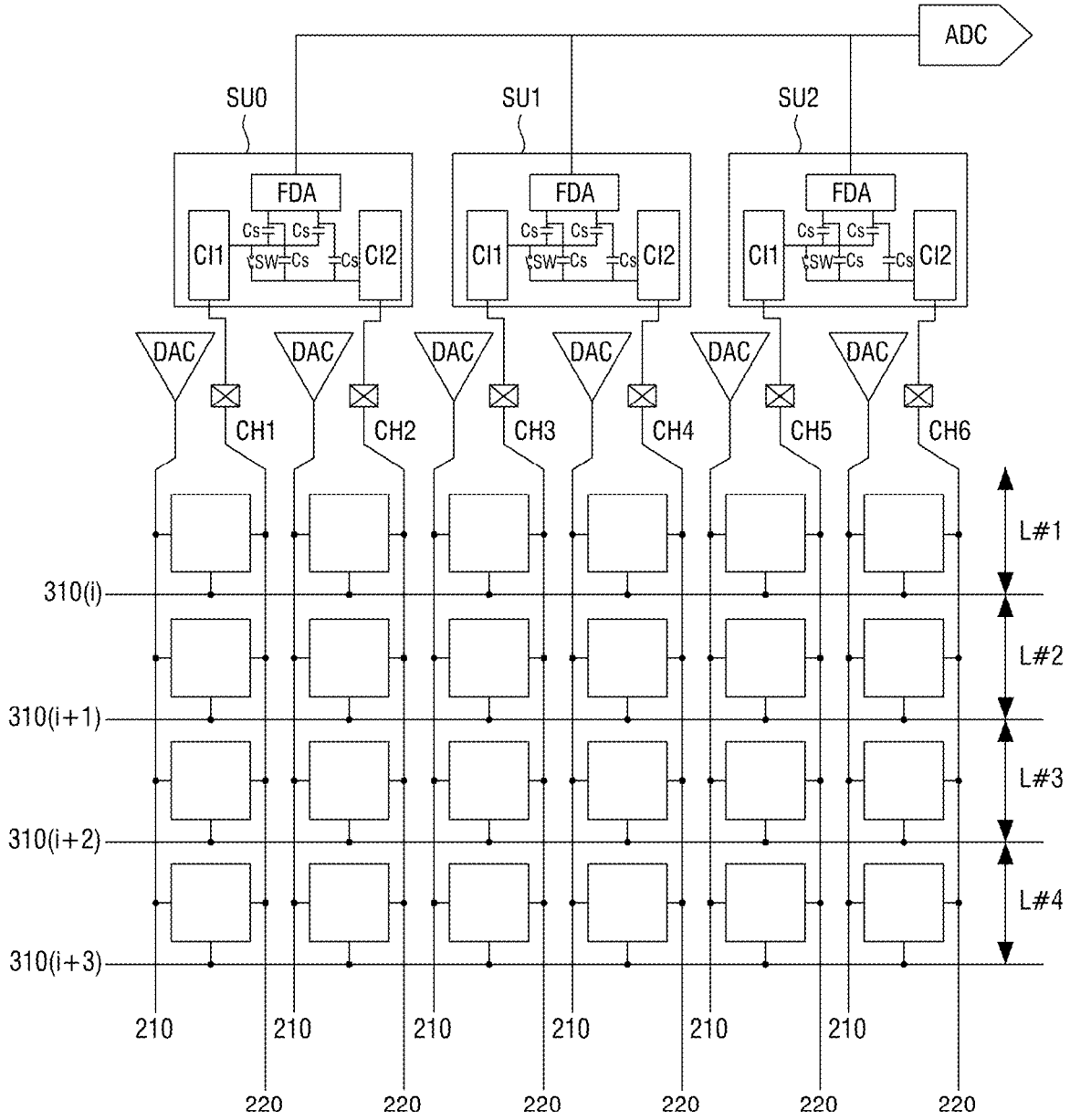
FIG. 5 illustrates a pixel array formed in a display panel of FIG. 4 and a sensing circuit according to an example embodiment.

FIG. 4 is a block diagram of an OLED display device according to an embodiment of the present disclosure, and FIG. 5 illustrates a pixel array formed in a display panel of FIG. 4 and a sensing circuit according to some embodiments of the present disclosure.

Referring to FIGS. 4 and 5, an OLED display device 10 may include a display panel 100, a data driving circuit 200, a gate driving circuit 300, a timing controller 400, and a memory 500.

In the display panel 100, a plurality of data lines 210 and a plurality of sensing lines 220 may intersect a plurality of gate lines 310, and pixels P may be disposed at the intersections between the data lines 210/the sensing lines 220 and the gate lines 310 and may be disposed in a matrix.

Each of the pixels P may connect to one of the data lines 210, to one of the sensing lines 220, and to one of the gate lines 310. Each of the pixels P may electrically connect to one of the data lines 210 in response to a gate pulse input thereto via one of the gate lines 310 to receive a data voltage from the corresponding data line 210 and to output a sensing signal via one of the sensing lines 220.

Each of the pixels P may receive a high-potential driving voltage EVDD and a low-potential driving voltage EVSS from a power generator (not illustrated). Each of the pixels P may include an OLED "OLED", a driving transistor T_DRV, first and second switches T_SW1 and T_SW2, and a storage capacitor C_ST. That is, the pixels P may have the same structure as the pixel "Pixel" of FIG. 2A. The transistors of the pixels P may be implemented as p- or n-type transistors. Also, the semiconductor layers of the transistors of the pixels P may include amorphous silicon, polysilicon, or an oxide.

The pixels P may operate differently for a display operation for displaying an image and for a sensing operation for obtaining sensing values. The sensing operation may be performed ahead of the display operation for a predetermined amount of time or during vertical blank periods during the display operation.

The display operation may consist of first operations of the data driving circuit 200 and the gate driving circuit 300 that are performed under the control of the timing controller 400. The sensing operation may consist of second operations of the data driving circuit 200 and the gate driving circuit 300 that are performed under the control of the timing controller 400. An operation of deducing compensated data for compensating for deviations based on sensing result data and an operation of modulating digital video data RGB using the compensated data are performed by the timing controller 400.

The data driving circuit 200 may include at least one data driver IC "SDIC". The data driver IC "SDIC" may include a plurality of DACs which are connected to the data lines 210, a plurality of sensing circuits SU0, SU1, and SU2 which are connected to the sensing lines 220 via sensing channels CH1~CH6, and an ADC which is connected in common to the sensing circuits SU0, SU1, and SU2.

During the display operation, the DACs of the data driver IC "SDIC" may convert the digital video data RGB into data voltages for displaying an image and provides the data voltages for displaying an image to the data lines 210 in accordance with a data timing control signal DDC applied thereto from the timing controller 400.

During the sensing operation, the DACs of the data driver IC "SDIC" may generate data voltages for sensing and provides the data voltages for sensing to the data lines 210 in accordance with the data timing control signal DDC applied thereto from the timing controller 400. Here, the data voltages for sensing may include a gray data voltage for generating a pixel current Ipix (or the source-drain current of each driving transistor T_DRV) higher than 0 and a black data voltage for suppressing the generation of a pixel current Ipix. During the sensing operation, the data driver IC "SDIC" may alternately supply the gray data voltage and the black data voltage to the data lines 210 so that the gray data voltage and the black data voltage can be alternately supplied to channels, particularly, columns of pixels P connected to the channels. For example, if the gray data voltage is supplied to a column pixel connected to a first channel CH1, the black data voltage may be applied to a column of pixels connected to a second channel CH2. In another example, if the black data voltage is supplied to the column pixel connected to the first channel CH1, the gray data voltage may be applied to the column of pixels connected to the second channel CH2.

Figure 6:
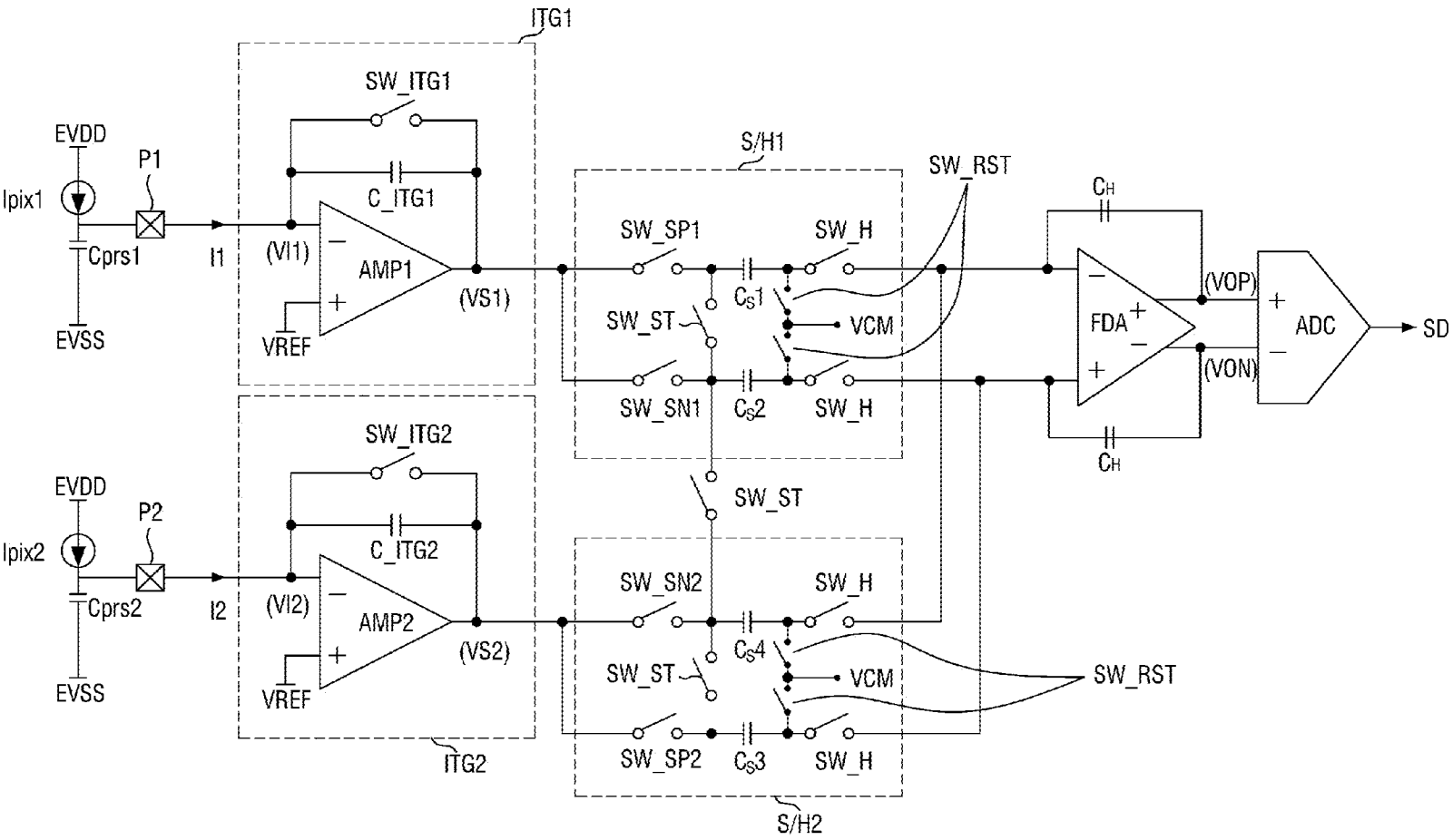
FIG. 6 is a circuit diagram of an OLED display device including an OLED driving characteristic detection circuit according to an example embodiment.

Each of the sensing circuits SU0, SU1, and SU2 of the data driver IC "SDIC" may include a first current integrator CI1 which may connect to one of the odd-numbered sensing channels, (e.g., the first channel CH1, a third channel CH3, and a fifth channel CH5), a second current integrator CI2 which is connected to one of even-numbered sensing channels, (e.g., the second channel CH2, a fourth sensing channel CH4, and a sixth sensing channel CH6), and four sampling capacitors CS which are connected between the output terminal of the first current integrator CI1 and the output terminal of the second current integrator CI2. The first and second current integrators CI1 and CI2 of FIG. 5 may be implemented as illustrated in FIG. 6. The ADC of the data driver IC "SDIC" may sequentially digitalize the outputs of the sensing circuits SU0, SU1, and SU2 and transmit the digitalized outputs to the timing controller 400. Operations of the sensing circuits SU0, SU1, and SU2 will be described later in detail with reference to FIGS. 6 to 12.

During the display operation, the gate driving circuit 300 generates gate pulses for displaying an image based on a gate control signal GDC and sequentially supplies the gate pulses for displaying an image to the gate lines 310 in a row-sequential manner (L #1, L #2 . . . ). During the sensing operation, the gate driving circuit 300 generates gate pulses for sensing based on the gate control signal GDC and sequentially supplies the gate pulses for sensing to the gate lines 310 in the row-sequential manner (L #1, L #2 . . . ). The gate pulses for sensing may have wider on-pulse sections than the gate pulses for displaying an image. The on-pulse sections of the gate pulses for sensing correspond to "one-line sensing on-time". Here, the term "one-line sensing on-time" refers to the amount of scan time that it takes to sense each row of pixels P (i.e., L #1, L #2 . . . ) at the same time.

The timing controller 400 may generate the data control signal DDC for controlling the operational timing of the data driving circuit 200 in accordance with timing signals (e.g., a vertical synchronization signal Vsync, a horizontal synchronization signal Hsync, a dot clock signal DCLK, and a data enable signal DE), and the gate control signal GDC for controlling the operational timing of the gate driving circuit 300. The timing controller 400 may identify the display operation and the sensing operation based on predetermined reference signals (e.g., a driving power enable signal, the vertical synchronization signal Vsync, and the data enable signal DE) and generate the data control signal DDC and the gate control signal GDC appropriately for each of the display operation and the sensing operation.

During the sensing operation, the timing controller 400 may transmit digital data corresponding to the data voltages for sensing to the data driving circuit 200. The digital data may include first digital data corresponding to the gray data voltage and second digital data corresponding to the black data voltage. During the sensing operation, the timing controller 400 may deduce a threshold voltage deviation ΔVth and a mobility deviation ΔK of each driving transistor T_DRV by applying digital sensing values SD, received from the data driving circuit 200, to a previously-stored compensation algorithm and store, in the memory 500, compensated data for compensating for the deduced deviations.

During the display operation, the timing controller 400 may modulate the digital video data RGB reference to the compensated data stored in the memory 500 and transmit the modulated digital video data to the data driving circuit 200.

FIG. 6 is a circuit diagram of an OLED display device including an OLED driving characteristic detection circuit according to an example embodiment.

Referring to FIG. 6, the OLED driving characteristic detection circuit may include a first current integrator ITG1, a second current integrator ITG2, a first sample/hold circuit S/H1, a second sample/hold circuit S/H2, and an FDA "FDA".

The first current integrator ITG1 may receive a first current Ia applied thereto via a first pad P1 and may generate a first integrated output voltage VS1. For example, the first pad P1 may be a pad connected to the first channel CH1 of FIG. 5. That is, the first current integrator ITG1 may receive the source-drain current of a driving transistor of a pixel connected to the first pad P1, (e.g., a pixel current Ipix1), but may receive the first current Ia having, reflected thereinto, noise caused under the influence of a parasitic capacitor Cprs1 generated in the process of generating the low-potential driving voltage EVSS. The first current Ia may be a current generated based on a gray data voltage. This operation may be a sensing operation for sensing the driving characteristics of the driving transistor of the pixel connected to the first pad P1.

The first current integrator ITG1 may include a first amplifier AMP1, a first integration capacitor C_ITG1, and a first integration switch SW_ITG1. The first amplifier AMP1, the first integration capacitor C_ITG1, and the first integration switch SW_ITG1 may perform the same operations as the amplifier AMP, the capacitor C_ITG, and the switch SW_ITG, respectively, of FIG. 2A. That is, the voltage across the first integration capacitor C_ITG1 may be initialized by the first integration switch SW_ITG1, and the first amplifier AMP1 may perform integration based on the first current Ia to generate and output the first integrated output voltage VS1.

The second current integrator ITG2 may receive a second current Ib applied thereto via a second pad P2 and may generate a second integrated output voltage VS2. For example, the second pad P2 may be a pad connected to the second channel CH2 of FIG. 5. That is, the second current integrator ITG2 may receive the source-drain current of a driving transistor of a pixel connected to the second pad P2, i.e., a pixel current Ipix2, but may receive the second current Ib having, reflected thereinto, noise caused under the influence of a parasitic capacitor Cprs2, which is generated in the process of generating the low-potential driving voltage EVSS. The second current Ib may be a current generated based on a black data voltage.

A second amplifier AMP2, a second integration capacitor C_ITG2, and a second integration switch SW_ITG2 of the second current integrator ITG2 may perform the same operations as the first amplifier AMP1, the first integration capacitor C_ITG1, and the first integration switch SW_ITG1, respectively. That is, the voltage across the second integration capacitor C_ITG2 may be initialized by the second integration switch SW_ITG2, and the second amplifier AMP2 may perform integration based on the second current Ib to generate and output the second integrated output voltage VS2.

A sampling circuit may include the first sample/hold circuit S/H1 and the second sample/hold circuit S/H2. The first sample/hold circuit S/H1 may include a first sampling switch SW_SP1, a second sampling switch SW_SN1, a sampling transfer switch SW_ST, a first sampling capacitor Cs1, a second sampling capacitor Cs2, two sampling reset switches SW_RST, and two hold switches SW_H.

In a first sensing period, the first sampling switch SW_SP1 may be turned off to store the first integrated output voltage VS1 in the first sampling capacitor Cs1. The first sensing period may be an early sensing period.

In a second sensing period, which follows the first sensing period, the second sampling switch SW_SN1 may be turned off to store the first integrated output voltage VS1 in the second sampling capacitor Cs2.

When the first integrated output voltage VS1 is stored in the first and second sampling capacitors Cs1 and Cs2, the sampling reset switches SW_RST of the first sample/hold circuit S/H1 may be turned off to apply a sampling reference voltage VCM to first ends of the first and second sampling capacitors Cs1 and Cs2. By fixing the sampling reference voltage VCM to the first ends of the first and second sampling capacitors Cs1 and Cs2, the first integrated output voltage VS1 can be stored in the first and second sampling capacitors Cs1 and Cs2.

In a transfer period, which follows the second sensing period, the first and second sampling switches SW_SP1 and SW_SN1 and the sampling reset switches SW_RST of the first sample/hold circuit S/H1 may be turned off, and the sampling transfer switch SW_ST and the hold switches SW_H of the first sample/hold circuit S/H1 may be turned on. In response to the sampling transfer switch SW_ST being turned on, the first ends of the first and second sampling capacitors Cs1 and Cs2 and first ends of third and fourth sampling capacitors Cs3 and Cs4 may be connected to one another. Also, in response to the hold switches SW_H of the first sample/hold circuit S/H1 being turned on, the voltage stored in the first sampling capacitor Cs1 may be applied to an inverted input node (−) of the FDA "FDA", and the voltage stored in the second sampling capacitor Cs2 may be applied to a non-inverted input node (+) of the FDA "FDA".

The second sample/hold circuit S/H2 may include a third sampling switch SW_SP2, a fourth sampling switch SW_SN2, a sampling transfer switch SW_ST, Cs3, the third sampling capacitor Cs3, the fourth sampling capacitor Cs4, two sampling reset switches SW_RST, and two hold switches SW_H.

In the first sensing period, the third sampling switch SW_SP2 may be turned on to store the second integrated output voltage VS2 in the third sampling capacitor Cs3. In the second sensing period, the fourth sampling switch SW_SN2 may be turned on to store the second integrated output voltage VS2 in the fourth sampling capacitor Cs4.

The sampling reset switches SW_RST of the second sample/hold circuit S/H2 may operate in the same manner as the sampling reset switches SW_RST of the first sample/hold circuit S/H1. That is, in the first and second sensing periods, the sampling reset switches SW_RST of the second sample/hold circuit S/H2 may be turned on to apply the sampling reference voltage VCM to first ends of the third and fourth sampling capacitors Cs3 and Cs4.

In the transfer period, the third and fourth sampling switches SW_SP2 and SW_SN2 and the sampling reset switches SW_RST of the second sample/hold circuit S/H2 may be turned off, and the sampling transfer switch SW_ST and the hold switches SW_H of the second sample/hold switch S/H2 may be turned on. In response to the sampling transfer switch SW_ST of the second sample/hold switch S/H2 being turned on, the first ends of the first through fourth sampling capacitors Cs1 to Cs4 may be connected to one another. Also, in response to the hold switches SW_H of the second sample/hold circuit S/H2 being turned on, the voltage stored in the third sampling capacitor Cs3 may be applied to the non-inverted input node (+) of the FDA "FDA", and the voltage stored in the fourth sampling capacitor Cs4 may be applied to the inverted input node (−) of the FDA "FDA".

The FDA "FDA" may receive sampled voltages from the first and second sample/hold circuits S/H1 and S/H2 via the inverted input node (−) and the non-inverted input node (+) of the FDA "FDA" and may output a non-inverted output voltage VOP and an inverted output voltage VON to a non-inverted input node (+) and an inverted input node (−), respectively, of an ADC "ADC". In some embodiments, a voltage transmitted to the ADC "ADC" may be a voltage corresponding to the difference between the non-inverted output voltage VOP and the inverted output voltage VON, i.e., an output voltage "VOP-VON". The output voltage "VOP-VON" will hereinafter be assumed and described as being input to the ADC "ADC".

The ADC "ADC" receives the output voltage "VOP-VON" from the FDA "FDA" and outputs a digital value SD, which is obtained by analog-to-digitalizing the output voltage "VOP-VON", to a timing controller 400, and the timing controller 400 may generate compensated data based on the digital value SD, as already described above with reference to FIG. 4.

Figure 7:
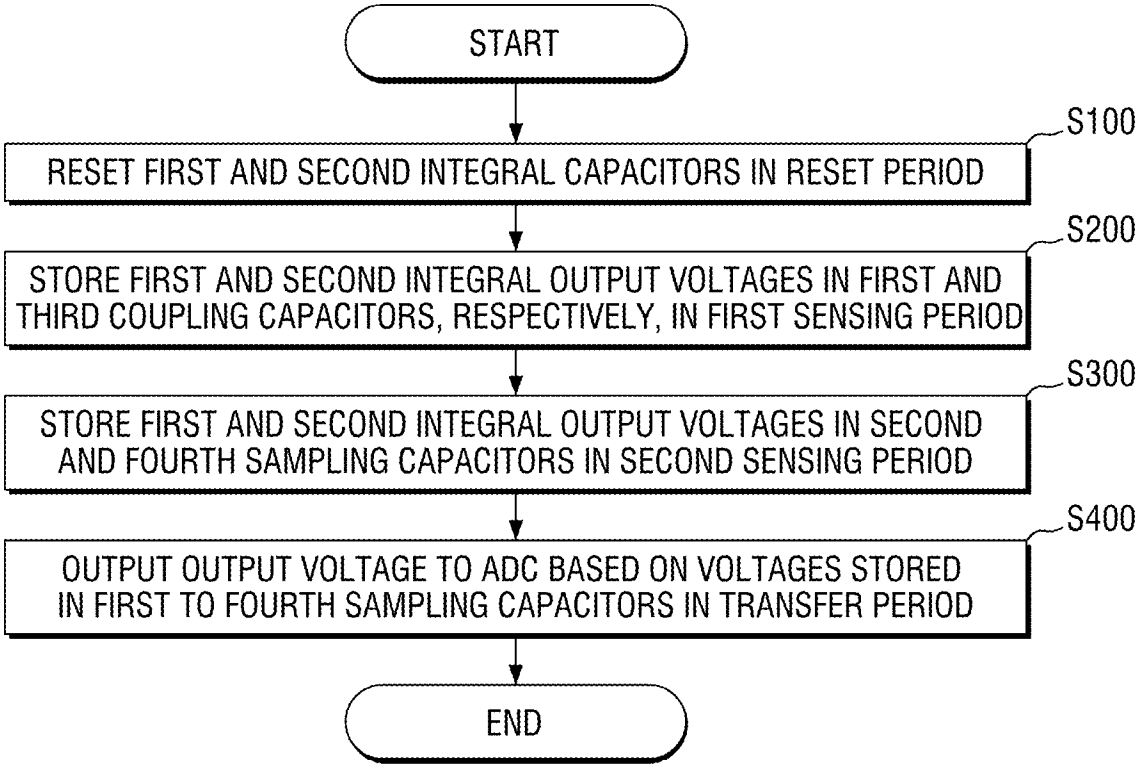
FIG. 7 is a flowchart illustrating a sensing operation of an OLED display device, according to an example embodiment.
Figure 8A:
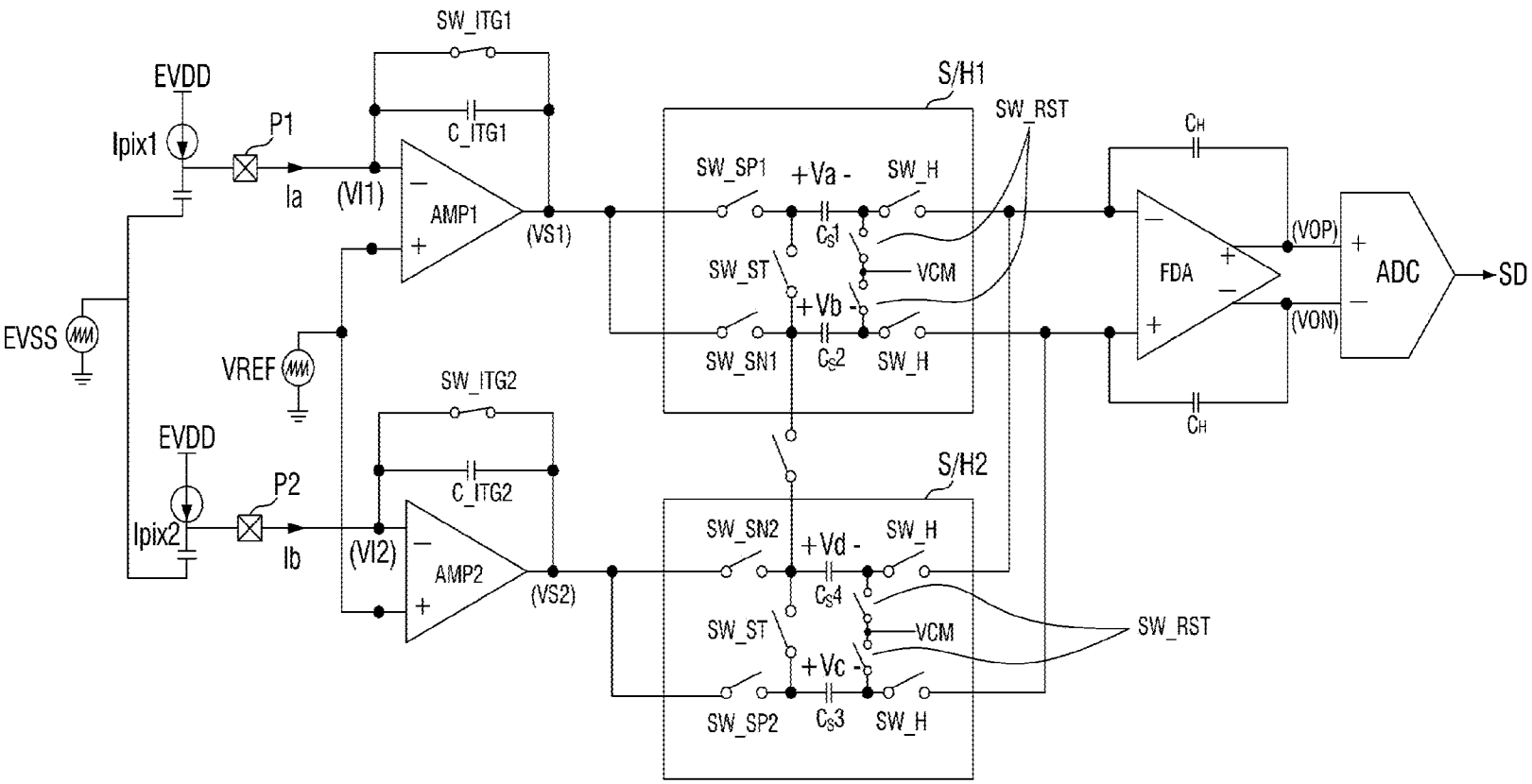
FIGS. 8A to 8D are circuit diagrams illustrating how to remove noise that may be generated in the process of sensing a current according to an embodiment.
Figure 8B:
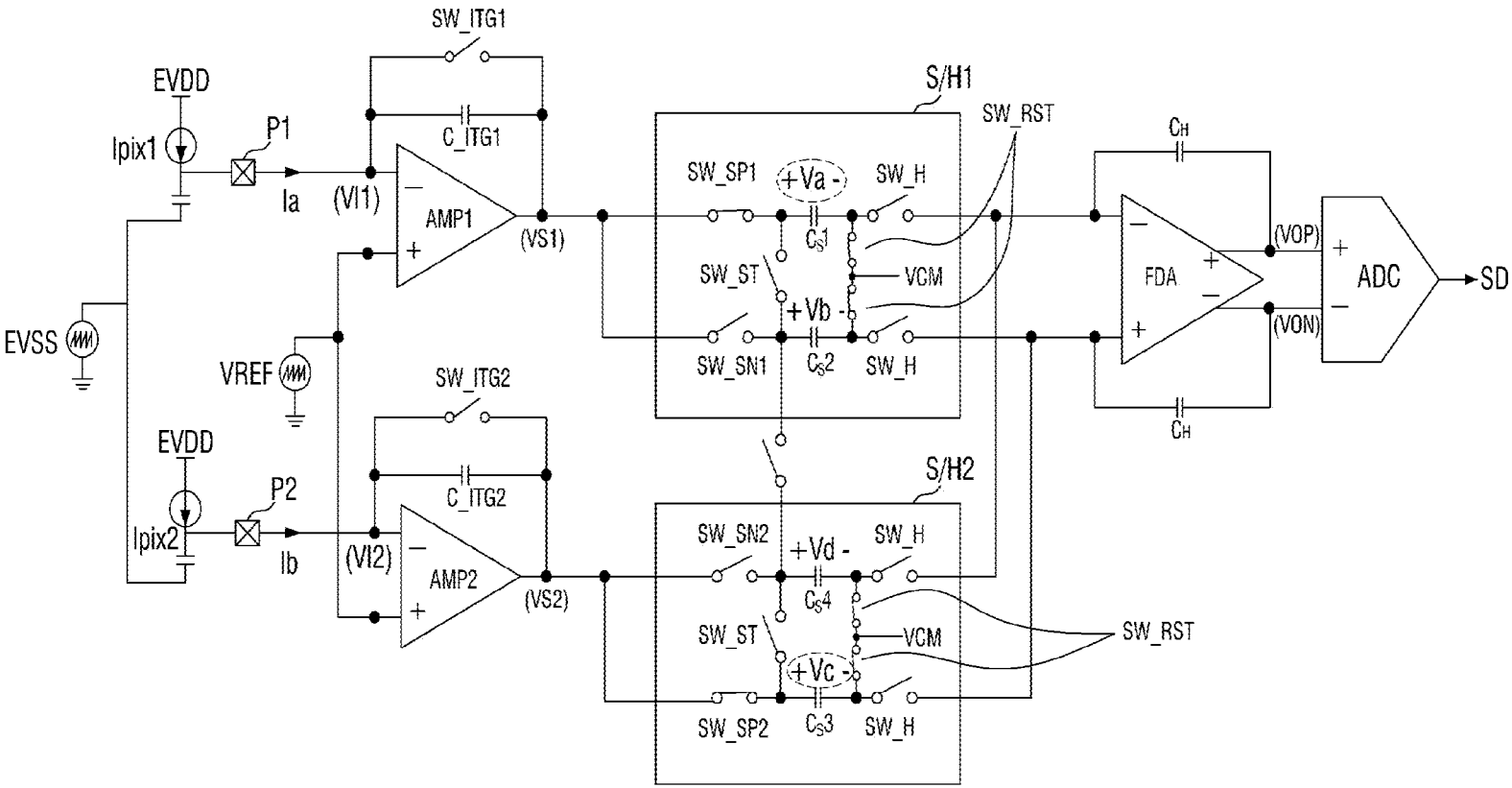
Figure 8C:
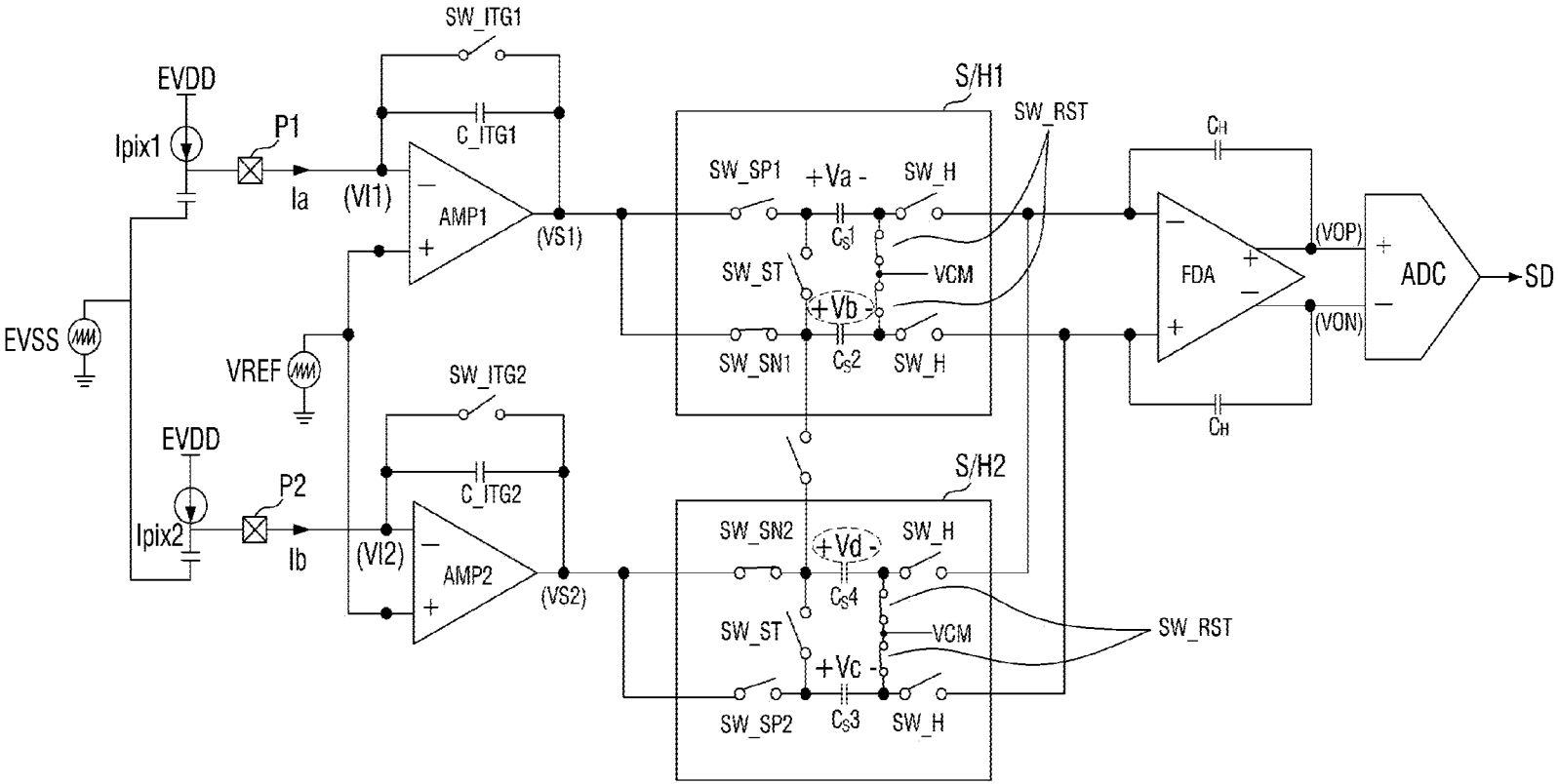
Figure 8D:
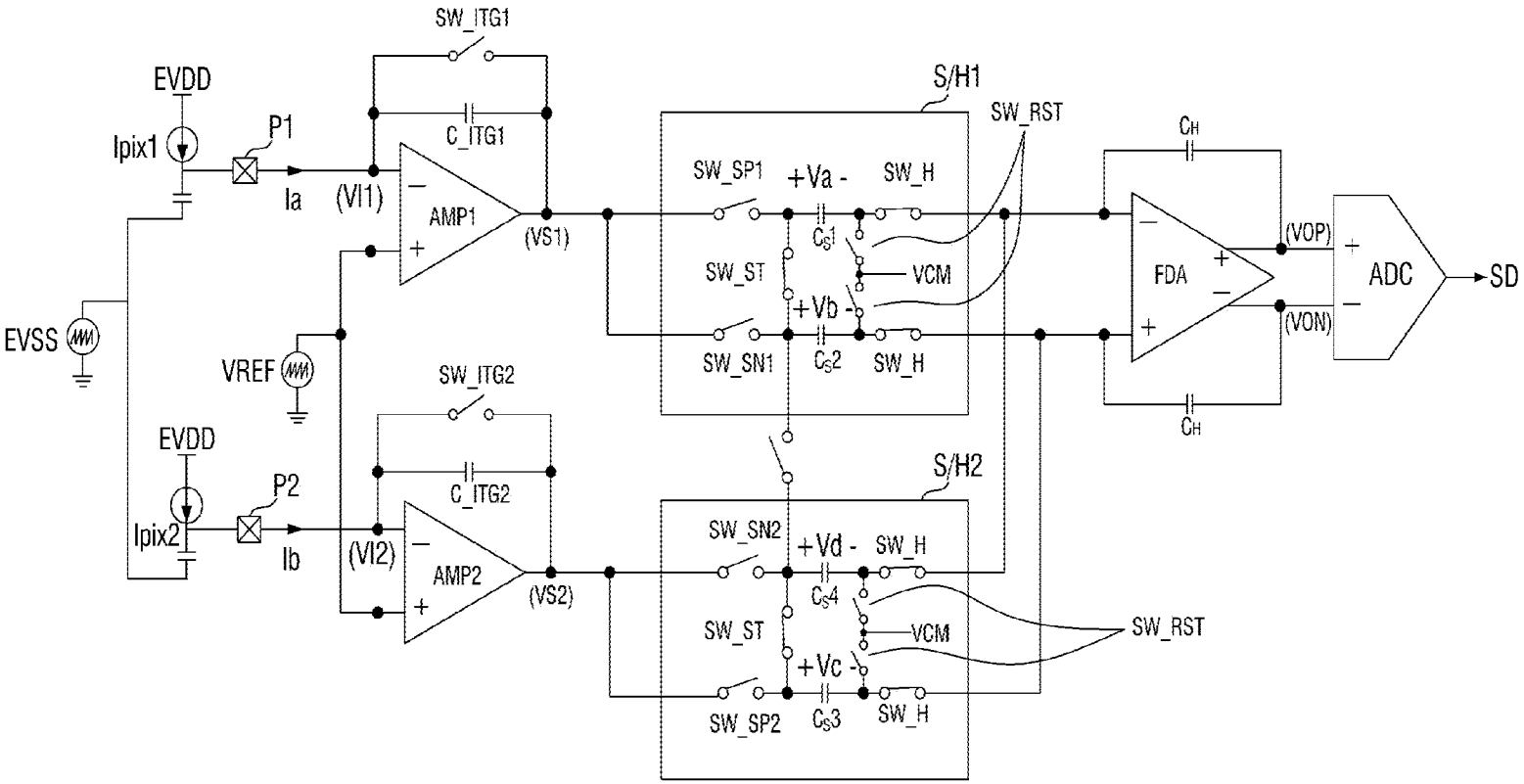
Figure 9:
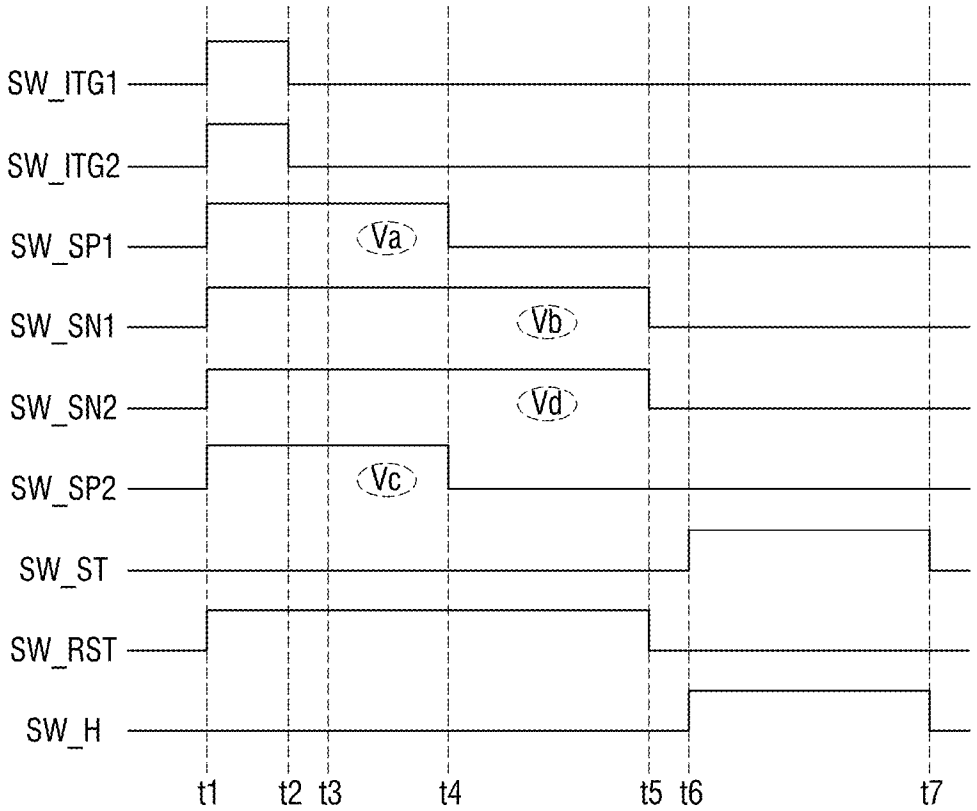
FIG. 9 is a timing diagram illustrating the states of switches of an OLED driving characteristic detection circuit according to an example embodiment.
Figure 10:
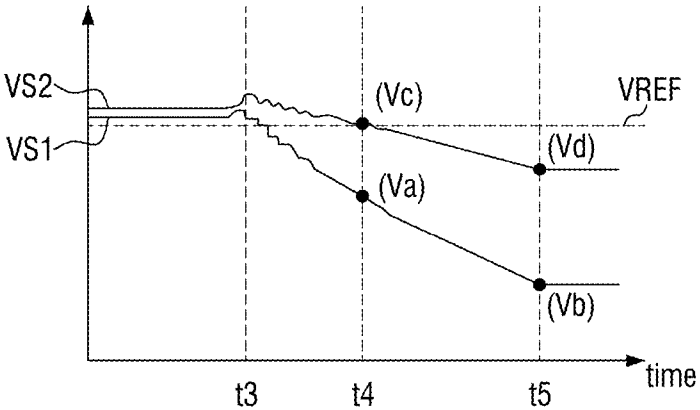
FIG. 10 is a graph illustrating how noise can be removed by four capacitors according to an example embodiment.

FIG. 7 is a flowchart illustrating a sensing operation of an OLED display device, according to an example embodiment. FIGS. 8A to 8D are circuit diagrams illustrating how to remove noise that may be generated in the process of sensing a current according to some example embodiments. FIG. 9 is a timing diagram illustrating the states of switches of an OLED driving characteristic detection circuit according to an example embodiment. FIG. 10 is a graph illustrating how noise can be removed by four capacitors according to an example embodiment. It will hereinafter be described, with reference to FIGS. 7 to 9, how an OLED driving characteristic detection circuit according to some embodiments of the present disclosure senses the operating characteristics of a driving transistor. Detailed descriptions of features or elements that have already been described above with reference to FIG. 6 will be omitted.

Referring to FIGS. 7 to 9, in S100, a first integration capacitor C_ITG1 of a first current integrator ITG1 and a second integration capacitor C_ITG2 of a second current integrator ITG2 may be reset. That is, in a reset period that ranges from t1 to t2, first and second integration switches SW_ITG1 and SW_ITG2 may be turned on, and a reset operation may be performed so that the voltages across the first and second integration capacitors C_ITG1 and C_ITG2 can become identical. In some embodiments, in the reset period from t1 to t2, first, second, third, and fourth sampling switches SW_SP1, SW_SN1, SW_SP2, and SW_SN2 and sampling reset switches SW_RST may be turned on to track the outputs of the first and second current integrators ITG1 and ITG2.

After the reset period from t1 to t2, the first and second integration switches SW_ITG1 and SW_ITG2 may be turned off, and a sensing period that ranges from t3 to t5 may begin. FIG. 9 illustrates that there exists a delay between the reset period and the beginning of the sensing period, but the present disclosure is not limited thereto. That is, alternatively, the end of the reset period and the beginning of the sensing period may coincide with each other.

In S200, a first integrated output voltage VS1 may be stored in a first sampling capacitor Cs1, and a second integrated output voltage VS2 may be stored in a third sampling capacitor Cs3. That is, in a first sensing period that ranges from t3 to t4, the first and third sampling switches SW_SP1 and SW_SP2 may be turned off, and as a result, the storing of the first and second integrated output voltages VS1 and VS2 of the first and second current integrators ITG1 and ITG2 in the first and third sampling capacitors Cs1 and Cs3, respectively, may be completed. The first integrated output voltage VS1 stored in the first sampling capacitor Cs1 in the first sensing period from t3 to t4 is defined as a first sampling voltage Va, and the second integrated output voltage VS2 stored in the third sampling capacitor Cs3 in the first sensing period is defined as a third sampling voltage Vc.

In the sensing period from t3 to t5, sampling reset switches SW_RST of a first sample/hold circuit S/H1 and sampling reset switches SW_RST of a second sample/hold circuit S/H2 may be turned on to provide a sampling reference voltage VCM to first ends of the first to fourth sampling capacitors Cs1 to Cs4.

In S300, the first integrated output voltage VS1 may be stored in the second sampling capacitor Cs2, and the second integrated output voltage VS2 may be stored in the fourth sampling capacitor Cs4. That is, in a second sensing period that ranges from t4 to t5, the second and fourth sampling switches SW_SN1 and SW_SN2 may be turned off, and as a result, the storing of the first and second integrated output voltages VS1 and VS2 in the second and fourth sampling capacitors Cs2 and Cs4, respectively, may be completed. The first integrated output voltage VS1 stored in the second sampling capacitor Cs2 in the second sensing period from t4 to t5 is defined as a second sampling voltage Vb, and the second integrated output voltage VS2 stored in the fourth sampling capacitor Cs4 in the second sensing period is defined as a fourth sampling voltage Vd.

As already described above with reference to FIGS. 3A and 3B, during the reset period from t1 to t2 and the sensing period from t3 to t5, the noises "coupling(SW)", "offset (ITG)", "offset(VREF)", "noise(EVSS)", and "noise (VREF)" may be generated in the first and second current integrators ITG1 and ITG2, and the first to fourth sampling voltages Va to Vd having these noises reflected thereinto may be represented by Equations (1) to (4), respectively, below.

$$Va = VREF + (\text{coupling}(SW) + \text{offset}(ITG1) + \text{offset}(VREF) + \text{noise}(EVSS_{S1}) + \text{noise}(VREF_{S1})) - \frac{Ia(S1)}{C_{ITG1}} - VCM \quad \text{[Equation 1]}$$

$$Vb = VREF + (\text{coupling}(SW) + \text{offset}(ITG1) + \text{offset}(VREF) + \text{noise}(EVSS_{S2}) + \text{noise}(VREF_{S2})) - \frac{Ia(S2)}{C_{ITG1}} - VCM \quad \text{[Equation 2]}$$

$$Vc = VREF + (\text{coupling}(SW) + \text{offset}(ITG2) + \text{offset}(VREF) + \text{noise}(EVSS_{S1}) + \text{noise}(VREF_{S1})) - \frac{Ib(S1)}{C_{ITG2}} - VCM \quad \text{[Equation 3]}$$

$$Vd = VREF + (\text{coupling}(SW) + \text{offset}(ITG2) + \text{offset}(VREF) + \text{noise}(EVSS_{S2}) + \text{noise}(VREF_{S2})) - \frac{Ib(S2)}{C_{ITG2}} - VCM \quad \text{[Equation 4]}$$

Here, noise($EVSS_{S1}$) refers to noise generated by a low-potential driving voltage EVDD during the first sensing period from t3 to t4, noise($EVSS_{S2}$) refers to noise generated by the low-potential driving voltage EVDD during the second sensing period from t4 to t5, noise($VREF_{S1}$) refers to noise generated by a reference voltage VREF during the first sensing period from t3 to t4, noise($VREF_{S2}$) refers to noise generated by the reference voltage VREF during the second sensing period from t4 to t5, offset(ITG1) refers to noise caused by the offset present in the first current integrator ITG1 during a sensing operation, offset(ITG2) refers to noise caused by the offset present in the second current integrator ITG2 during the sensing operation, Ia(S1) refers to a first current Ia introduced via a first pad P1 during the first sensing period from t3 to t4, Ia(S2) refers to a first current Ia introduced via the first pad P1 during the second sensing period from t4 to t5, Ib(S1) refers to a second current Ib introduced via a second pad P2 during the first sensing period from t3 to t4, and Ib(S2) refers to a second current Ib introduced via the second pad P2 during the second sensing period from t4 to t5.

In S400, an output voltage "VOP-VON" may be transmitted to an ADC "ADC" based on the first to fourth sampling voltages Va, Vb, Vc, and Vd stored in the first to fourth sampling capacitors Cs1 to Cs4.

In a transfer period that ranges from t6 to t7, transfer switches SW_ST and hold switches SW_H are turned on, and the first, second, third, and fourth sampling switches SW_SP1, SW_SN1, SW_SP2, and SW_SN2 and the sampling reset switches SW_RST are turned off. Accordingly, the first to fourth sampling capacitors Cs1 to Cs4 are connected to one another, the first ends of the first and fourth sampling capacitors Cs1 and Cs4 are connected to an inverted input terminal (−) of an FDA "FDA", and the first ends of the second and third sampling capacitors Cs2 and Cs3 are connected to a non-inverted input terminal (+) of the FDA "FDA".

As a result, the output voltage "VOP-VON" of the FDA "FDA" may be represented by Equation (5) below.

$$\begin{aligned} VOP - VON &= \frac{Cs}{CH} * (Va + Vd) - \frac{Cs}{CH} * (Vb + Vc) \\ &= \frac{Cs}{CH} * (Va - Vb - Vc + Vd) \\ &= \frac{Ia(S2)}{C_{ITG1}} + \frac{Ib(S1)}{C_{ITG2}} - \frac{Ia(S1)}{C_{ITG1}} - \frac{Ib(S2)}{C_{ITG2}} \\ &= \left(\frac{Ia}{C_{ITG1}} - \frac{Ib}{C_{ITG2}}\right) * (S2 - S1) \end{aligned} \quad \text{[Equation 5]}$$

As already described above, a pixel current Ipix2 is a current that is obtained by applying a black data voltage and is thus ignorably low, and as a result, the second current Ib may also be a current that is ignorably low. Accordingly, the output voltage "VOP-VON" may also be represented by Equation (6) below.

$$VOP - VON = \left(\frac{Ia}{C_{ITG1}}\right) * (S2 - S1) \quad \text{[Equation 6]}$$

According to the embodiment of FIGS. 7 to 10, two sampling capacitors are provided to store the output voltage of each of two current integrators, and the output voltage of an FDA may be generated by performing computation on sampling voltages stored in the sampling capacitors. Thus, noises "coupling(SW)", "offset(ITG)", "offset(VREF)" that may be generated during a reset period and noises "noise (EVSS)", "noise(VREF)" that may be generated during a sensing period can be removed, and as a result, sensing for detecting the driving characteristics of each driving transistor can be precisely performed.

Figure 11:
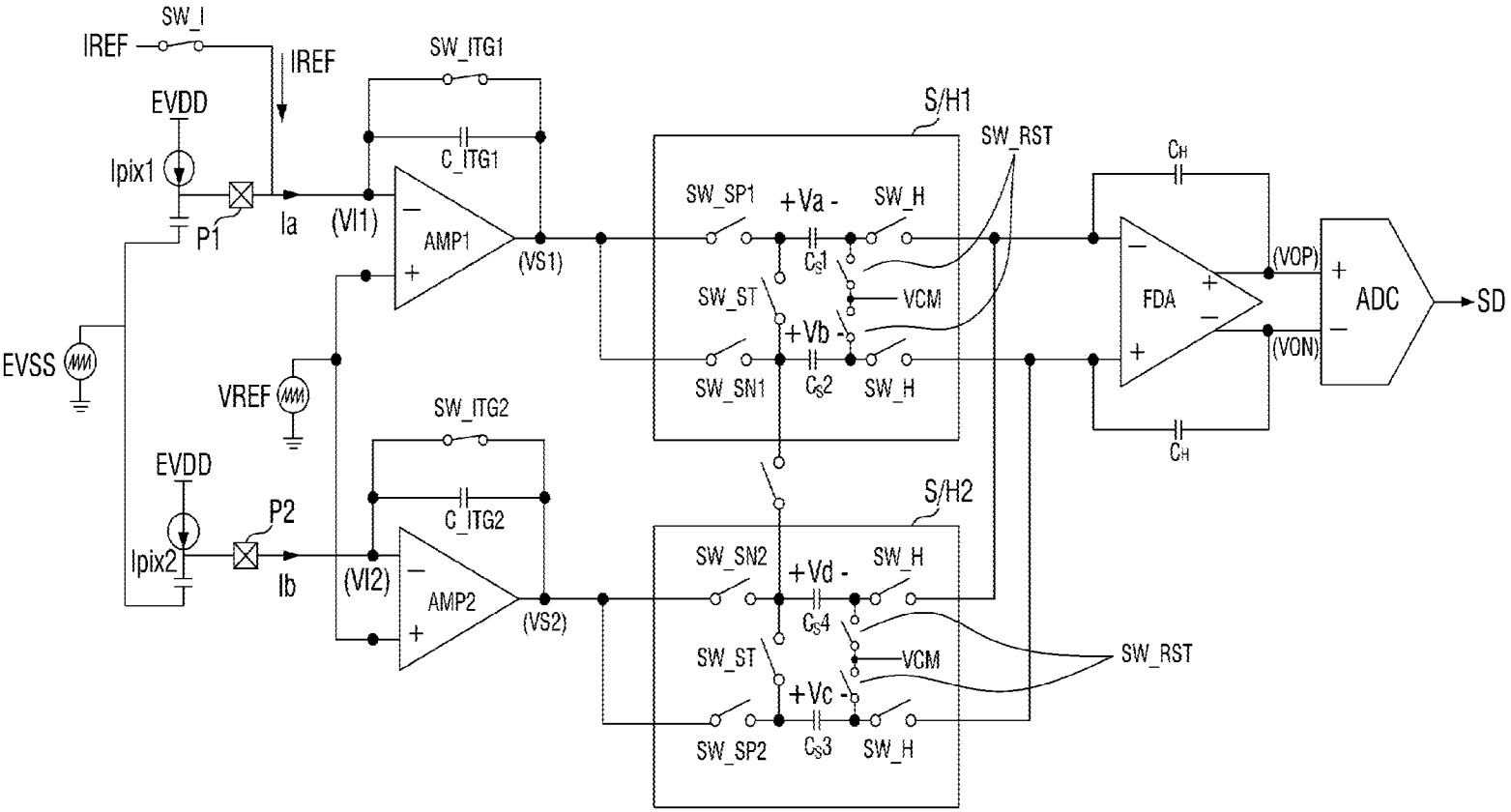
FIG. 11 is a circuit diagram illustrating how to remove noise that may be generated in the process of sensing a current according to an example embodiment.
Figure 12:
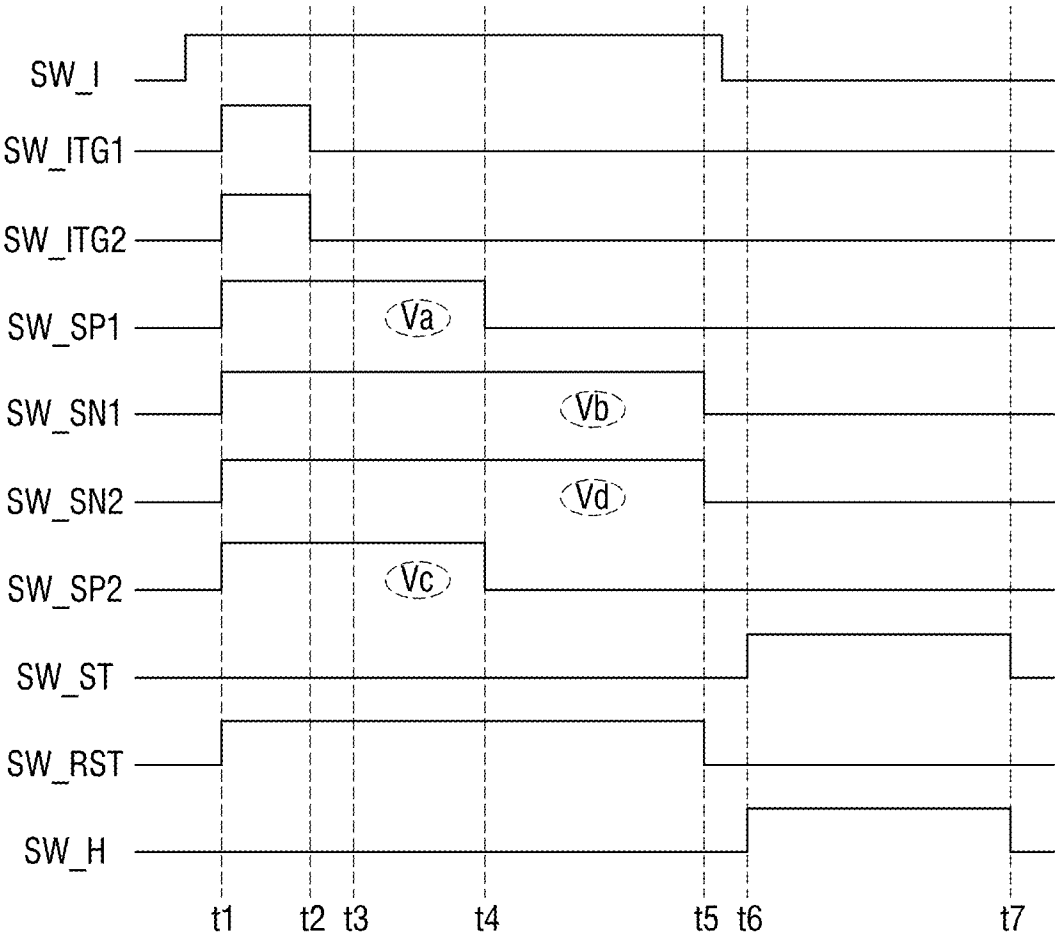
FIG. 12 is a timing diagram illustrating the states of switches of an OLED driving characteristic detection circuit according to an example embodiment.

FIG. 11 is a circuit diagram illustrating how to remove noise that may be generated in the process of sensing a current according to an example embodiment of the present disclosure. FIG. 12 is a timing diagram illustrating the states of switches of an OLED driving characteristic detection circuit according to an example embodiment. Detailed descriptions of features or elements that have already been described above with reference to FIGS. 7 to 10 will be omitted.

Referring to FIGS. 11 and 12, an OLED driving characteristic detection circuit according to some embodiments of the present disclosure and an OLED display device according to some embodiments of the present disclosure can precisely detect the capacitances of first and second integration capacitors C_ITG1 and C_ITG2 by applying a reference current IREF and can thus perform a sensing operation for detecting the driving characteristics of each driving transistor based on the results of the detection.

Current integrators necessary for the sensing operation may include a plurality of current integrators that are connected to each pixel, and the capacitances of current capacitors included in each current integrator may not necessarily be the same. Also, as the sensing operation is continued, the capacitances of the first and second integration capacitors C_ITG1 and C_ITG2 may vary due to external influence or internal noise, in which case, the driving capability of each driving transistor may not be able to be precisely detected.

Accordingly, the sensing operation may be performed by applying the reference current IREF, which is arbitrarily fixed, as the input of a first integration capacitor ITG1. In this case, the capacitance of the first integration capacitor C_ITG1, i.e., an integration capacitance $C_{ITG1}$, can be precisely detected, as indicated by Equation (7) below.

$$C_{ITG1} = \frac{IREF(S2 - S1)}{VOP - VON} \quad \text{[Equation 7]}$$

In a case where the sensing operation is performed using the integration capacitance $C_{ITG1}$, a further precise first current Ia can be detected, and a timing controller 400 can properly generate, store, and apply compensated data by using a compensation algorithm for a sensing value SD generated based on the first current Ia.

While embodiments are described above, it is not intended that these embodiments describe all possible forms of the inventive concept of the present disclosure. Rather, the words used in the specification are words of description rather than limitation, and it is understood that various changes may be made without departing from the spirit and scope of the inventive concept of the present disclosure. Additionally, the features of various implementing embodiments may be combined to form further embodiments of the present disclosure.

What is claimed is:

1. An organic light-emitting diode driving characteristic detection circuit comprising:

a first current integrator configured to receive a first current via a first sensing channel and output a first sampling voltage based on the first current;

a second current integrator configured to receive a second current via a second sensing channel and output a second sampling voltage based on the second current; and a sampling circuit having a plurality of sampling capacitors including a first sampling capacitor, a second sampling capacitor, a third sampling capacitor, and a fourth sampling capacitor, the first sampling capacitor and the second sampling capacitor connected to an output terminal of the first current integrator and configured to store and hold the first sampling voltage, the third sampling capacitor and the fourth sampling capacitor connected to an output terminal of the second current integrator and configured to store and hold the second sampling voltage, and a plurality of switches selectively connecting first ends of the first sampling capacitor, the second sample capacitor, the third sample capacitor, and the fourth sampling capacitor, and the sampling circuit configured to receive the first and second sampling voltages, to store and hold the first and second sampling voltages, and to remove common noise components included in the first and second sampling voltages.

2. The organic light-emitting diode driving characteristic detection circuit of claim 1, wherein the sampling circuit further includes a first sampling switch connected between the output terminal of the first current integrator and the first sampling capacitor, a second sampling switch connected between the output terminal of the first current integrator and the second sampling capacitor, a third sampling switch connected between the output terminal of the second current integrator and the third sampling capacitor, and a fourth sampling switch connected between the output terminal of the second current integrator and the fourth sampling capacitor, wherein the first sampling switch and the third sampling switch are configured to be turned off in a first period, and the second sampling switch and the fourth sampling switch are configured to be turned off in a second period, which is different from the first period.

3. The organic light-emitting diode driving characteristic detection circuit of claim 2, wherein the plurality of switches are turned on after the first sampling switch, the second sampling switch, the third sampling switch, and the fourth sampling switches are turned off.

4. The organic light-emitting diode driving characteristic detection circuit of claim 2, further comprising:

a differential amplifier configured to receive a first hold voltage and a second hold voltage from the sampling circuit and output an output voltage based on the first hold voltage and the second hold voltage; and an analog-to-digital converter configured to output a digital sensing signal based on the output voltage.

5. The organic light-emitting diode driving characteristic detection circuit of claim 4, wherein the differential amplifier includes a fully differential amplifier (FDA), the output voltage is a difference between a non-inverted output voltage and an inverted output voltage of the differential amplifier, and the output voltage is input to the analog-to-digital converter.

6. The organic light-emitting diode driving characteristic detection circuit of claim 5, wherein the first sampling capacitor and the fourth sampling capacitor are connected to an inverted input terminal of the differential amplifier, and the second sampling capacitor and the third sampling capacitor are connected to a non-inverted input terminal of the differential amplifier.

7. The organic light-emitting diode driving characteristic detection circuit of claim 6, further comprising:

a first hold switch connected between the first sampling capacitor and the inverted input terminal of the differential amplifier;

a second hold switch connected between the second sampling capacitor and the non-inverted input terminal of the differential amplifier;

a third hold switch connected between the third sampling capacitor and the non-inverted input terminal of the differential amplifier; and a fourth hold switch connected between the fourth sampling capacitor and the non-inverted input terminal of the differential amplifier, wherein the first hold switch, the second hold switch, the third hold switch, and the fourth hold switch are turned on in the same period.

8. The organic light-emitting diode driving characteristic detection circuit of claim 1, wherein the sampling circuit further includes a plurality of reference switches which are each connected to the first sampling capacitor to the fourth sampling capacitor and operate to apply a sampling reference voltage to the first sampling capacitor, the second sampling capacitor, the third sampling capacitor, and the fourth sampling capacitor.

9. The organic light-emitting diode driving characteristic detection circuit of claim 1, wherein each of the first current integrator and the second current integrator includes an amplifier, the amplifier including a first input terminal, a second input terminal, and an output terminal, an integration capacitor, and an integration switch, the first input terminal connected to the first sensing channel or the second sensing channel, the integration capacitor connected between the first input terminal and the output terminal of the amplifier, and the integration switch connected between both ends of the integration capacitor and configured to reset the integration capacitor, the second input terminal configured to receive an integrated reference voltage, and the output terminal configured to output the first sampling voltage or the second sampling voltage.

10. An organic light-emitting diode driving characteristic detection circuit comprising:

a first current integrator configured to receive a first current via a first sensing channel and output a first sampling voltage based on the first current;

a second current integrator configured to receive a second current via a second sensing channel and output a second sampling voltage based on the second current; and a sampling circuit configured to receive the first and second sampling voltages, to store and hold the first and second sampling voltages, and to remove common noise components included in the first and second sampling voltages, the sampling circuit including a plurality of sampling capacitors including a first sampling capacitor, a second sampling capacitor, a third sampling capacitor, and a fourth sampling capacitor, the first sampling capacitor configured to store the first sampling voltage;

a first sampling switch connected between an output terminal of the first current integrator and the first sampling capacitor, the first sampling switch configured to be turned off in a first period to complete the storing of the first sampling voltage in the first sampling capacitor;

the second sampling capacitor configured to store the first sampling voltage;

a second sampling switch connected between the output terminal of the first current integrator and the second sampling capacitor, the second sampling switch configured to be turned off in a second period after the first period to complete the storing of the first sampling voltage in the second sampling capacitor;

the third sampling capacitor configured to store the second sampling voltage;

a third sampling switch connected between the output terminal of the second current integrator and the third sampling capacitor, the third sampling switch configured to be turned off in the first period to complete the storing of the second sampling voltage in the third sampling capacitor;

the fourth sampling capacitor configured to store the second sampling voltage; and a fourth sampling switch connected between the output terminal of the second current integrator and the fourth sampling capacitor, the fourth sampling switch configured to be turned off in the second period to complete the storing of the second sampling voltage in the fourth sampling capacitor.

11. The organic light-emitting diode driving characteristic detection circuit of claim 10, wherein each of the first and second current integrators includes an amplifier, the amplifier having a first input terminal, a second input terminal, an output terminal, an integration capacitor, and an integration switch, the first input terminal connected to the first sensing channel or the second sensing channel, the second input terminal configured to receive an integrated reference voltage, and the output terminal configured to output the first sampling voltage or the second sampling voltage, the integration capacitor connected between the first input terminal and the output terminal of the amplifier, and the integration switch connected between both ends of the integration capacitor and resets the integration capacitor, wherein the integration switch is configured to be turned on before the first period and reset the integration capacitor and be maintained to be turned off in the first and second periods.

12. The organic light-emitting diode driving characteristic detection circuit of claim 10, wherein the sampling circuit further includes a plurality of switches, the plurality of switches connecting first ends of the first sampling capacitor, the second sampling capacitor, the third sampling capacitor, and the fourth sampling capacitor, and the plurality of switches configured to turn on in a third period after the second period to connect the first sampling capacitor, the second sampling capacitor, the third sampling capacitor, and the fourth sampling capacitor.

13. The organic light-emitting diode driving characteristic detection circuit of claim 12, further comprising:

a differential amplifier configured to receive a first hold voltage via an inverted input terminal of the sampling circuit and a second hold voltage from a non-inverted input terminal of the sampling circuit, and output an output voltage based on the first hold voltage and the second hold voltage; and an analog-to-digital converter configured to receive the output voltage and output a digital sensing signal on the output voltage, wherein, the first sampling capacitor and the fourth sampling capacitor are connected to the inverted input terminal of the differential amplifier, and the second sampling capacitor and the third sampling capacitor are connected to the non-inverted input terminal of the differential amplifier.

14. The organic light-emitting diode driving characteristic detection circuit of claim 13, further comprising:

a first hold switch connected between the first sampling capacitor and the inverted input terminal of the differential amplifier;

a second hold switch connected between the second sampling capacitor and the non-inverted input terminal of the differential amplifier;

a third hold switch connected between the third sampling capacitor and the non-inverted input terminal of the differential amplifier; and a fourth hold switch connected between the fourth sampling capacitor and the inverted input terminal of the differential amplifier, wherein the first hold switch, the second hold switch, the third hold switch, and the fourth hold switch are turned on in the third period to connect the first sampling capacitor, the second sampling capacitor, the third sampling capacitor, and the fourth sampling capacitor and the inverted input terminal or the non-inverted input terminal of the differential amplifier.

15. The organic light-emitting diode driving characteristic detection circuit of claim 13, wherein the differential amplifier includes a fully differential amplifier (FDA), the output voltage is a difference between a non-inverted output voltage and an inverted output voltage of the differential amplifier, and the output voltage is input to the analog-to-digital converter.

16. The organic light-emitting diode driving characteristic detection circuit of claim 12, wherein the sampling circuit further includes a plurality of reference switches, the plurality of reference switches connected to the first sampling capacitor, the second sampling capacitor, the third sampling capacitor, and the fourth sampling capacitor, the plurality of reference switches configured to apply a sampling reference voltage to the first sampling capacitor, the second sampling capacitor, the third sampling capacitor, and the fourth sampling capacitor, and the plurality of reference switches configured to turned off in the third period.

17. An organic light-emitting diode display device comprising:

a display panel having a plurality of pixels connected to data lines and sensing lines, the plurality of pixels including an organic light-emitting diode (OLED) and a driving thin-film transistor (TFT), the driving TFT configured to control an amount of light emitted by the OLED; and a data driving circuit including a digital-to-analog converter (DAC), a plurality of sensing circuits, and an analog-to-digital converter (ADC), the DAC configured to apply data voltages for sensing to the data lines during a sensing operation, the plurality of sensing circuits configured to senses current information of the pixels via a plurality of sensing channels, connected to the sensing lines, during the sensing operation, each of the sensing circuits including a first current integrator, a second current integrator, a sampling circuit, the first current integrator configured to receive a first current via a first sensing channel and output a first sampling voltage, the second current integrator configured to receive a second current via a second sensing channel and output a second sampling voltage, and the sampling circuit configured to receive, store, and hold the first sampling voltage and the second sampling voltage and remove common noise components included in the first sampling voltage and the second sampling voltage, the sampling circuit including a plurality of capacitors including a first sampling capacitor, a second capacitor, a third sampling capacitor, and a fourth sampling capacitor, the first sampling capacitor and the second sampling capacitor connected to an output terminal of the first current integrator and configured to store the first sampling voltage, the third sampling capacitor and the fourth sampling capacitor connected to an output terminal of the second current integrator and configured to store the second sampling voltage, and a plurality of switches connecting first ends of the first sampling capacitor, the second sampling capacitor, the third sampling capacitor, and the fourth sampling capacitor, and the ADC is connected in common to the sensing circuits.

18. The organic light-emitting diode display device of claim 17, wherein the sampling circuit further including a first sampling switch, a second sampling switch, a third sampling switch, and a fourth sampling switch, the first sampling switch connected between the output terminal of the first current integrator and the first sampling capacitor, the first sampling switch configured to be turned off in a first period to complete the storing of the first sampling voltage in the first sampling capacitor, the second sampling switch connected between the output terminal of the first current integrator and the second sampling capacitor, the second sampling switch configured to be turned off in a second period after the first period to complete the storing of the first sampling voltage in the second sampling capacitor, the third sampling switch connected between the output terminal of the second current integrator and the third sampling capacitor, the third sampling switch configured to be turned off in the first period to complete the storing of the second sampling voltage in the third sampling capacitor, the fourth sampling switch connected between the output terminal of the second current integrator and the fourth sampling capacitor, the fourth sampling switch configured to be turned off in the second period to complete the storing of the second sampling voltage in the fourth sampling capacitor, and the plurality of switches are configured to turn on in a third period after the second period to connect the first sampling capacitor, a second sampling capacitor, a third sampling capacitor, and the fourth sampling capacitor.

19. The organic light-emitting diode display device of claim 17, wherein the data voltages for sensing include a first data voltage, which generates a pixel current higher than 0 and a second data voltage that generates no pixel current, a driving TFT of a first pixel is configured to generate the first current by applying the first data voltage, the driving TFT of the first pixel connected to the first sensing channel, a driving TFT of a second pixel is configured to generate the second current by applying the second data voltage, the driving TFT of the second pixel connected to the second sensing channel, and the sensing circuits are configured to sense driving characteristics of the driving TFT of the first pixel based on the first current and the second current.

20. The organic light-emitting display device of claim 17, wherein the data voltages for sensing include a first data voltage, which generates a pixel current higher than 0 and a second data voltage that generates no pixel current, a driving TFT of a first pixel and a driving TFT of a second pixel are configured to receive the second data voltage in a first period, the driving TFT of the first pixel connected to the first sensing channel, the driving TFT of the second pixel connected to the second sensing channel, the first current integrator is configured to receive a reference current as input in the first period, and the sensing circuits are configured to determine a capacitance of an integration capacitor connected between an input terminal and the output terminal of the first current integrator based on the reference current and on the second current in the first period, and the driving TFT of the first pixel is configured to receive the first data voltage to generate the first current in a second period after the first period, the driving TFT of the second pixel is configured to receive second data voltage to generate the second current in the second period, and the sensing circuits are configured to sense driving characteristics of the driving thin-film transistor of the first pixel based on the capacitance of the integration capacitor and on the first current and the second current in the second period.

* * * * *